US006088937A

United States Patent [19]

DiClementi et al.

[11] Patent Number: 6,088,937

[45] **Date of Patent: *Jul. 18, 2000**

[54] VEHICLE PLOW SUSPENSION SYSTEM

[76] Inventors: James Anthony DiClementi, 1909 E. Euclid Ave., Mount Prospect, Ill. 60056; Robert Daniel DiClementi, 2110 Illinois Rd., Northbrook, Ill. 60062; Linda Rose DiClementi, 911 N. Kennicott, Arlington Heights, Ill. 60004

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,675

[22] Filed: Mar. 5, 1998

[51] Int. Cl.[7] ..... E01H 5/04; F16M 13/00

[52] U.S. Cl. ..... 37/232; 37/235; 248/565; 248/610

[58] Field of Search ..... 37/232, 234, 235, 37/236; 248/565, 610, 611

[56] References Cited

U.S. PATENT DOCUMENTS

| | | | |
|---|---|---|---|
| 1,195,271 | 8/1916 | Ruth | 37/232 |
| 1,365,153 | 1/1921 | Clark | 37/232 |
| 1,907,078 | 9/1933 | Weeks | 37/234 |
| 1,957,771 | 5/1934 | Gettelman | 37/232 |
| 2,057,326 | 10/1936 | Coates | 37/235 |
| 2,139,625 | 12/1938 | Pruss | 37/232 |
| 2,152,091 | 3/1939 | Rougier | 37/232 |
| 3,853,311 | 12/1974 | Kreuzer et al. | 267/64 R |
| 3,893,518 | 7/1975 | Farrell | 172/794 |
| 4,216,570 | 8/1980 | Farris et al. | 29/434 |
| 4,843,744 | 7/1989 | Jansen | 37/232 |
| 4,947,563 | 8/1990 | Pfister, Jr. | 37/231 |
| 4,967,681 | 11/1990 | Strain et al. | 114/215 |
| 5,044,098 | 9/1991 | Berghefer | 137/232 |
| 5,109,618 | 5/1992 | Grübler et al. | 37/232 |
| 5,116,016 | 5/1992 | Nagata | 248/578 |
| 5,121,562 | 6/1992 | Feller | 37/235 |
| 5,155,929 | 10/1992 | Vachon | 37/266 |
| 5,191,729 | 3/1993 | Verseef | 37/232 |
| 5,245,771 | 9/1993 | Walsh | 37/269 |
| 5,249,781 | 10/1993 | Wohler | 267/33 |
| 5,277,394 | 1/1994 | Slemmer | 248/570 |
| 5,415,235 | 5/1995 | Gebauer | 172/273 |
| 5,638,618 | 6/1997 | Niemela et al. | 37/281 |

*Primary Examiner*—Eileen Dunn Lillis
*Assistant Examiner*—Gary S. Hartmann
*Attorney, Agent, or Firm*—Piper Marbury Rudnick & Wolfe

[57] ABSTRACT

A vehicle plow suspension system designed for use with a large object such as a plow blade is disclosed. The suspension system is disposed between and connected to the plow blade and its associated positioning means, and comprises an expansion spring coaxially mounted about a two-way shock absorber in a sealed housing. The suspension system operates to attenuate both the relative movement between the plow blade and its associated vehicle, and the resultant forces thereby transmitted from the plow blade to the vehicle.

12 Claims, 2 Drawing Sheets

VEHICLE PLOW SUSPENSION SYSTEM

FIELD OF THE INVENTION

This invention relates to vehicle mounted plows. More specifically, the invention relates to an improved plow suspension system for attenuating shocks normally imparted to a vehicle as the vehicle moves over and across uneven terrain.

BACKGROUND OF THE INVENTION

Vehicles having snow plow blades affixed to a front end thereof are in common use. Most of such plow blades are releasably mounted on the truck. As is well known, such plow blades have a substantial mass and are very heavy. Moreover, the plow blades are mounted to the frame of the vehicle for movement between a lowered working or operational position and a raised storage or suspended position.

Typical plow suspension systems include a mounting structure or frame attached to the forward end of the vehicle. It is common for such mounting structures to be releasably attached to the frame of the vehicle. Usually, the plow blade is hung or suspended forwardly of the mounting structure in a manner permitting vertical movement. A lift assembly operably positions the plow blade between its suspended transport or raised position and its operating or lowered position. Such lift assembly usually includes a lift arm adapted for movement about a pivotal axis. A driver controls movement of the lift arm and thereby the plow blade. A chain or cable system typically interconnects the plow blade to the lift arm.

As the vehicle is driven across uneven terrain or surfaces, i.e. railroad crossings, ruts, potholes and the like, the elevated plow blade can present significant problems and major difficulties. More specifically, when the plow blade is not in its lowered or work engaging position, the momentum imparted to the plow blade as the vehicle is driven over uneven terrain causes the suspended plow blade to bounce. That is, the uneven surface terrain causes initial upward movement of the plow blade toward the lift arm and subsequent forceful movement downwardly until the chains or cable limit its travel. Without any plow suspension system, when the plow blade reaches the travel limit of the associated chain or cable, such chain or cable will jerk the plow blade to a sudden stop, transmitting a sudden and sharp jolt of force back to the vehicle through the mounting structure. As will be appreciated, such bouncing of the plow blade happens repeatedly as the vehicle is driven or transported between locations.

As will also be appreciated, the suspension system on the front of the vehicle exacerbates the plow blade bouncing problem. Moreover, the effect of the significant mass/weight of the plow blade on the vehicle suspension system is significantly magnified when considering the repetitive bouncing movement of the plow blade as the vehicle is driven from location to location. This repeated bouncing of the plow blade can adversely impact the vehicle's suspension system by causing significant and rapid wear and tear thereof. Moreover, repeated bouncing of the plow blade can result in damage to a vehicle frame and/or the plow blade mounting structure. Furthermore, repeated bouncing of the plow blade causes extreme tensile stress loading of the chains or cables holding the plow blade in a suspended position. Of course, if such chains or cables should snap or break, the plow blade will crash thus enhancing the potential for accidents not only with the vehicle having the plow blade mounted thereon, but with other vehicles in the vicinity.

Also, the potential bouncing of the plow blade can interfere with the steerability of the vehicle. All of these problems may be further magnified by the likelihood of adverse weather conditions normally including snow and/or ice laden streets and highways.

Furthermore, similar problems and difficulties may be encountered when the plow blade is lowered to its operating position. In this position, the plow blade is in contact with the road or off-road surface the vehicle is traveling on. To ensure proper contact between the plow and the surface to be plowed, the lift assembly is positioned such that the chains or cables do not support the full weight of the plow. The surfaces to be plowed, however, are commonly marred with uneven portions such as the joints associated with misaligned road surface segments, speed bumps, ruts, potholes and the like. When the plow blade contacts such imperfections in the road surface, the plow blade may be forced initially upward and then subsequently downward back to the road. Without any plow suspension system, the plow blade will freely plummet back to the ground or, if the surface imperfection is large enough, will snap to a sudden stop as the chains or cables are drawn taut. The resulting forces can be quite severe, and these forces are transmitted back to the vehicle through the mounting structure. As will be appreciated, such displacement of the plow blade may happen repeatedly as the vehicle operates to plow road and similar surfaces.

Thus, there is a need and a desire for a plow blade suspension system capable of attenuating shocks normally imparted to a vehicle by a plow blade as the vehicle moves over and across uneven terrain.

U.S. Pat. No. 4,947,563, issued to Paul T. Pfister, Jr., discloses a vehicle plow-suspension shock-absorber. Pfister involves a compression spring situated in line with the chain or cable that interconnects the plow blade to the lift arm. By adding such a compression spring, downward forces on the plow blade relative to the vehicle are dampened when the plow blade is in the raised storage or suspension position. Pfister, however, does not dampen the upward movement of the plow blade, and has little if any effect when the plow blade is in the lowered working or operational position.

SUMMARY OF THE INVENTION

The invention may be broadly defined as a device for attenuating shock to a motor vehicle when a large object such as a plow blade is mounted thereon.

The invention is designed to be used in combination with: (1) a large object such as a plow blade structure; (2) a vehicular mount for said plow blade structure; and (3) a positioning means, such as a hydraulically operated lift arm, which allows the plow blade to be moved between its lowered working or operational position and its raised storage or suspended position. The invention, a vehicle plow suspension system, is disposed between said plow blade structure and said positioning means, and uses suitable chains or cables to connect said plow blade structure to said positioning means.

The vehicle plow suspension system dampens the relative movement between the plow blade and vehicle, the resulting forces, and the transmission of such forces from the plow blade to the vehicle. Both upward and downward relative movement are dampened, and the invention operates both when the plow blade is in its raised storage or suspended position and when the plow blade is in its lowered working or operational position.

The invention comprises, in combination, an expansion spring and a two-way shock absorber. The two-way shock absorber comprises a closed housing or cylinder with a piston slidably movable for endwise movement therewithin. As is conventional, the piston has a piston rod extending from one end of the housing. The free end of the piston rod is suitably attached to the cable or chain extending to the positioning means. Intermediate its ends, but outside of the closed cylinder or housing, the piston rod is affixed to an end cap. The opposite end of the two-way shock absorber has a second rod endwise extending therefrom. The rod extending from the lower end of the cylinder or housing is suitably connected to the lower chain or cable extending to the plow blade. Notably, the second rod of the two-way shock absorber is likewise affixed to a second end cap.

Opposite ends of the expansion spring forming part of the vehicle plow suspension system are attached to the end caps. In the preferred form of the invention, the exterior of each end cap is provided with external threading axially extending therealong. The ends of the spring are threaded upon and wound about the respective end caps and are affixed thereto to prevent the spring from separating from the end caps.

In a preferred form of the invention, a cover is provided to protect the spring and two-way shock absorber. The cover includes a pair of telescopically movable members that are connected at opposite ends to the end caps.

As the vehicle is driven between locations, the positioning means is normally conditioned to elevate the plow blade to a raised storage or suspended position. In such position, in accordance with the present invention, the expansion spring of the shock absorbing apparatus of the present invention resiliently suspends the plow blade in a raised position. Overextension of the expansion spring is prevented by the travel limit associated with the two-way shock absorber. When unstable road conditions are encountered, such as road divots, potholes, unstable railroad crossings, medians, and the like, the shock absorbing apparatus of the present invention controls movement of the raised plow blade to decrease shock to the vehicle. When the plow blade moves upwardly in response to the vehicle moving over rough or bumpy terrain, the piston of the two-way shock absorber moves endwise within the housing under controlled conditions. The two-way shock absorber and the expansion spring combine with each other to control the downward movement of the plow blade thus attenuating the shock imparted to the vehicle. By floating the weight of the plow blade on the expansion spring, the present invention significantly attenuates the shock imparted to the vehicle as compared to the dead weight of a plow blade merely suspended by a chain or cable. The two-way shock absorber dampens the oscillations in the expansion spring.

When the plow blade is in the lowered working or operational position, as is customary, the weight of the plow blade is substantially supported by the surface to be plowed. This arrangement ensures that the plow blade will make adequate contact with the plowing surface such that snow and similar objects on the surface may be removed by the plow blade. Thus, the expansion spring of the present invention supports little to none of the weight of the plow blade. However, as is common in the field, due to the unevenness or other imperfections in the plowing surface, forces may be imparted to the plow blade which cause relative motion between the plow blade and the vehicle, and resultant forces transmitted to the vehicle. The suspension system of the present invention allows this necessary movement but, under appropriate circumstances, can temporarily "float" weight of the plow and thus reduce the forces which result when the plow blade returns to the plowing surface.

This and other objects of the invention may be better understood by making reference to the following Figures and Detailed Description.

DETAILED DESCRIPTION OF THE DRAWINGS

DESCRIPTION OF THE PRESENT INVENTION

Figure 1:
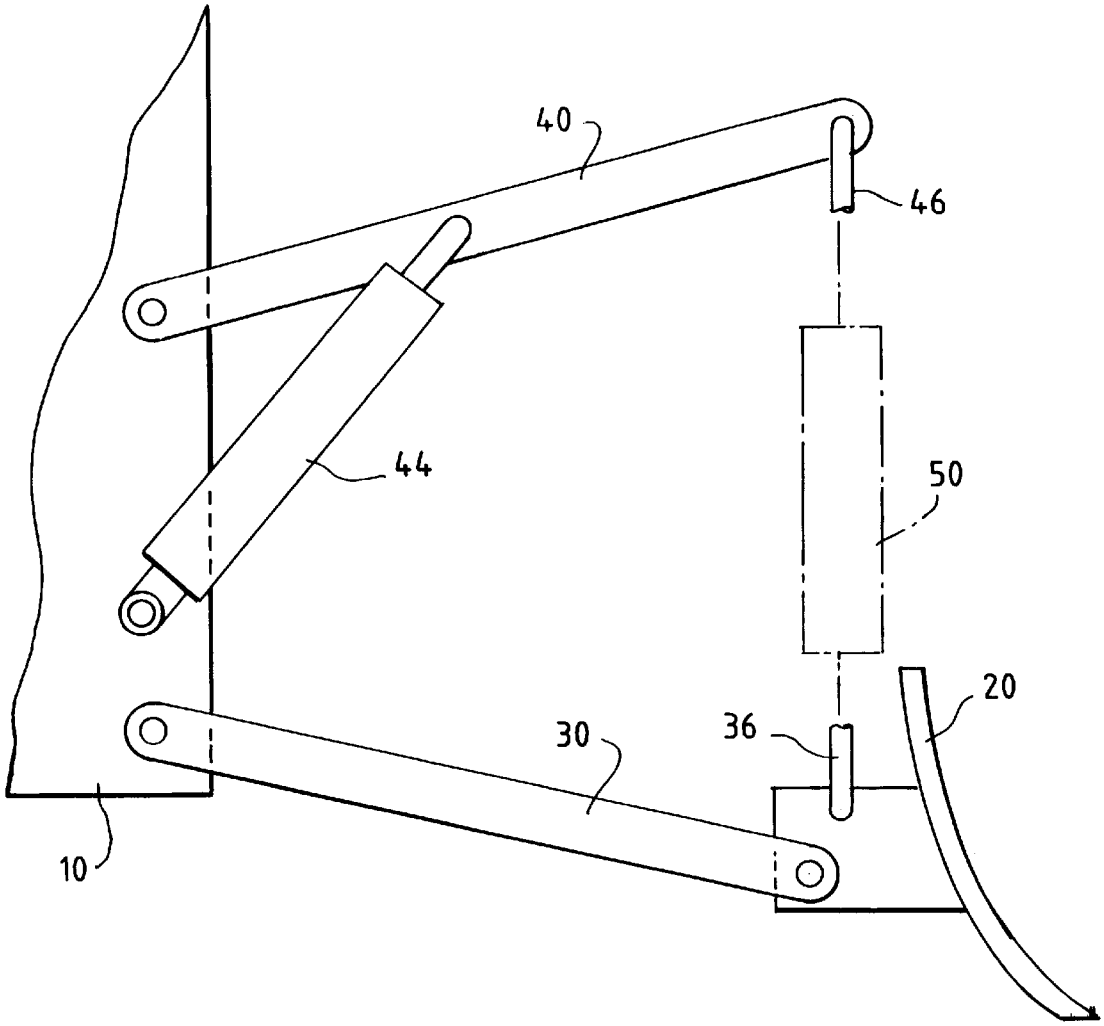
FIG. 1 is a side view of the vehicle plow suspension system in combination with a plow blade, a vehicular mount, and a positioning means.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to FIG. 1, there is shown a side view of the vehicle plow suspension system 50 in combination with a plow blade 20, a vehicular mount 30, a vehicle 10, and a positioning means. The positioning means illustrated includes a lift arm 40 and a hydraulically operated lift cylinder 44, although the present invention is designed to operate with any positioning means that similarly operates to position a plow blade and the like by means of a cable or chain. The vehicle plow suspension system 50 is connected to the plow blade 20 by lower chains or cable 36, and to the positioning means by upper chains or cable 46.

Figure 2:
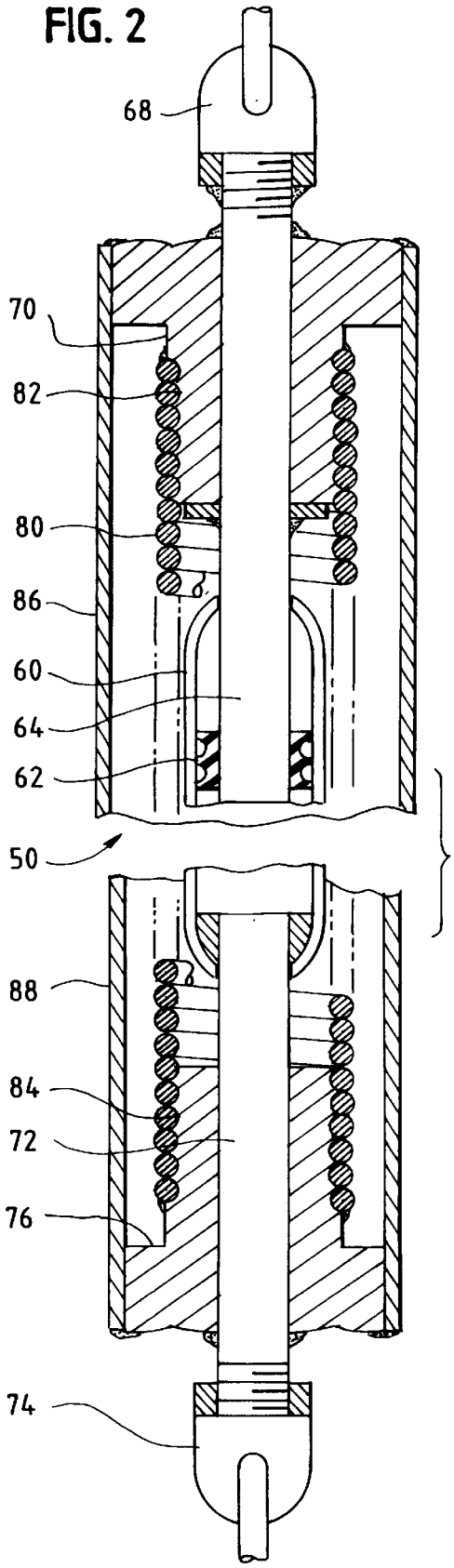
FIG. 2 is an enlarged and partially cut away view of the vehicle plow suspension system in accordance with the present invention.

The vehicle plow suspension system 50 may be better seen in FIG. 2, an enlarged and partially cut away view of the vehicle plow suspension system 50 in accordance with the present invention. A two-way shock absorber 60 acts in combination with an expansion spring 80 to dampen the forces caused by a moving plow blade 20 and its associated transmission back to vehicle 10. The two-way shock absorber 60 comprises a closed housing or cylinder 62 with a piston 64 slidably movable for endwise movement therewithin. As is conventional, the piston 64 has a piston rod extending from one end of the housing. In the preferred embodiment, the free end 66 of the piston rod 64 is threaded to mate with an end hook 68. The threaded end hook 68 allows the piston rod 64 to be suitably attached to the cable or chain 46 extending to the positioning means 40. Intermediate its ends, but outside of the closed cylinder or housing 62, the piston rod 64 is affixed to an end cap 70. The opposite end of the two-way shock absorber 60 has a second rod 72 endwise extending therefrom. The rod 72 extending from the lower end of the cylinder or housing 62 is similarly connected to the lower chain or cable 36, extending to the plow blade 20, by a second threaded end hook 74. Notably, the second rod 72 of the two-way shock absorber 60 is likewise affixed to a second end cap 76.

Opposite ends of the expansion spring 80 are attached to the end caps 70 and 76. In the preferred form of the invention, the exterior of each end cap 70 and 76 is provided with external threading 82 and 84 respectively, axially extending therealong. The ends of the spring 80 are threaded upon and wound about the respective end caps 70 and 76 and are affixed thereto to prevent the spring 80 from separating from the end caps 70 and 76.

In a preferred form of the invention, a cover is provided to protect the spring 80 and two-way shock absorber 60. The cover includes a pair of telescopically movable members 86 and 88 that are connected at opposite ends to the end caps 70 and 76 respectively.

Figure 3:
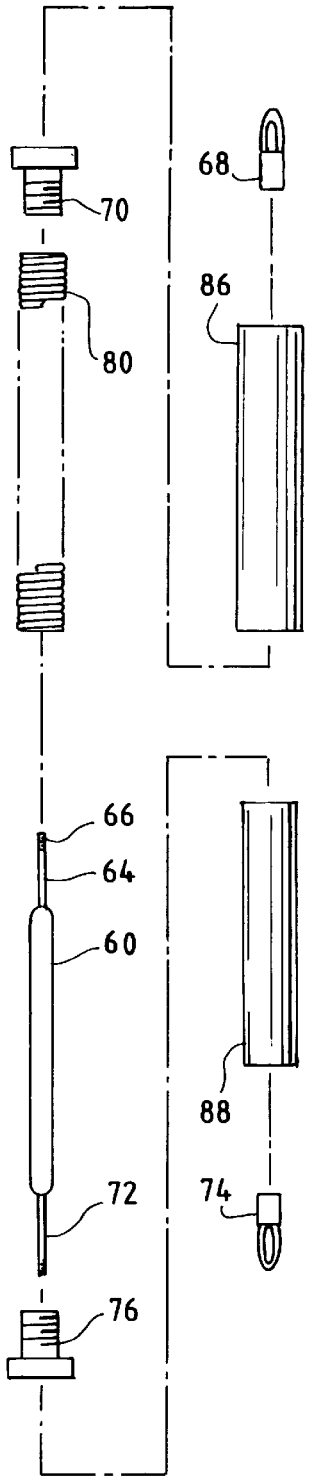
FIG. 3 is an exploded view of the component parts of the vehicle plow suspension system in accordance with the present invention.

The interaction of these parts may also be seen by reference to FIG. 3, an exploded view of the component parts of the vehicle plow suspension system in accordance with the present invention.

In operation, the vehicle plow suspension system 50 of the present invention serves to attenuate shocks normally imparted to the vehicle 10 from a mounted plow blade 20 as said vehicle 10 and mounted plow blade 20 move over and across uneven terrain, both when said plow blade 20 is in the raised storage or suspended position and when said plow blade 20 is in the lowered working or operational position.

When the positioning means such as a lift arm 40 and associated hydraulically operated lift cylinder 44 is conditioned to elevate the plow blade 20 to a raised storage or suspended position, the expansion spring 80 of the shock absorbing apparatus of the present invention 50 resiliently suspends the plow blade 20 in a raised position. Overextension of the expansion spring 80 is prevented by the travel limit associated with the two-way shock absorber 60. When a shock to the vehicle 10 and its mounted plow blade 20 is received, such as due to the encountering of unstable road conditions, the shock absorbing apparatus of the present invention 50 controls movement of the raised plow blade 20 to decrease shock to the vehicle 10. When the plow blade 20 is induced to move upwardly relative to the vehicle 10, the piston 64 of the two-way shock absorber 60 may move endwise within the housing 62 under controlled conditions such that relative motion between the plow blade 20 and the vehicle 10 is dampened. After the plow blade 20 reaches the (now reduced) apex of its upward travel relative to the vehicle 10, the two-way shock absorber 60 and the expansion spring 80 combine with each other to control the resultant downward movement of the plow blade 20 thus attenuating the shock imparted to the vehicle 10. Thus, by floating the weight of the plow blade 20 on the expansion spring 80, the present invention 50 significantly attenuates the shock imparted to the vehicle 10 as compared to the dead weight of a plow blade 20 merely suspended by a chain or cable. Furthermore, the two-way shock absorber 60 dampens the oscillations in the expansion spring 80.

When the plow blade 20 is in the lowered working or operational position, as is customary, the weight of said plow blade 20 is substantially supported by the surface to be plowed such that the plow blade 20 will make adequate contact with the plowing surface in order to remove snow and similar objects from said surface. Thus, the expansion spring 80 of the present invention 50 supports little to none of the weight of the plow blade 20 in this position. However, due to unevenness or other imperfections in the plowing surface, relative movement between the plow blade 20 and vehicle 10 may occur. The suspension system 50 of the present invention allows this necessary movement, but may act to reduce the resultant forces and their transmission to the vehicle 10. Where the plow blade 20 is induced to greater downward positions relative to the vehicle 10, the expansion spring 80 and two-way shock absorber 60 of the present invention may act to temporarily "float" or suspend the plow blade 20. This action will limit the eventual re-impact between the plow blade 20 and the plowing surface, and the resulting forces that may be transmitted to the vehicle 10 are likewise limited.

From the foregoing it will be observed that numerous modifications and variations can be effected without departing or detracting from the true spirit and scope of the novel concept of the present invention. For example, the present invention can be used to suspend large objects from vehicles other than a plow.

What is claimed is:

1. A suspension system for a load, mounted to a vehicle, such that the load may be raised to a transport position or lowered to an operating position by a positioning means, said suspension system being disposed between and connected to said load and said positioning means, movement of said positioning means being transmitted to said load only through said suspension system, said suspension system comprising:

(a) a two-way shock absorber having first and second ends, the first end being secured to said positioning means, the second end being secured to said load;

(b) an expansion spring co-axially positioned about said shock absorber, the first end of said expansion spring being secured to the first end of said shock absorber and the second end of said expansion spring being secured to the second end of the shock absorber;

whereby said suspension system attenuates both the relative movement between said load and said vehicle and the resultant forces transmitted from said load to said vehicle.

2. The suspension system of claim 1 where said two-way shock absorber includes: a housing with a first closed end and second open end; a piston and associated piston rod slidably movable for endwise movement therein and through the opening at the second end; and a housing rod extending from the first closed end of said housing; and means for connecting one of said piston and housing rods to the positioning means and the other of said piston and housing rods to the load.

3. The suspension system of claim 1 where said suspension system is connected to said positioning means and said load by chains.

4. The suspension system of claim 1 where said suspension system is connected to said positioning means and said load by cables.

5. The suspension system of claim 1 where said suspension system additionally includes a telescoping cover, wherein said cover is attached to corresponding ends of said suspension system and said cover is sized to enclose said suspension system and to be moveable therewith.

6. The suspension system of claim 2 where the end of each of said pistion and housing rods most distal from said housing includes threads such that said piston rod and said housing rod may each be secured to a reciprocally threaded end hook which secures the suspension system to said positioning means and said load.

7. A suspension system for a load suspended from a vehicle, such that the load may be raised to a transport position or lowered to an operating position by a positioning means, said suspension system being disposed between and connected to said load and said positioning means, said suspension system comprising:

(a) a two-way shock absorber having first and second ends, the first end being secured to said positioning means, the second end being secured to said load;

(b) said two-way shock absorber including a housing having a first end and a second end, said first housing end being closed and said second housing end being open, said shock absorber having a piston and associated piston rod slidably movable for endwise movement within said housing of said shock absorber, said piston rod extending through the opening at said second end of said housing; said shock absorber having a housing rod extending from the first closed end of said housing;

(c) said two-way shock absorber furthermore having a first end cap mounted to said piston rod and a second end cap mounted to said housing rod, both end caps having spring retaining means, said spring retaining means being threads formed in the end caps; and (d) an expansion spring being coaxially positioned about said two-way shock absorber, the first end of said expansion spring being secured to said first end cap by means of said threads, the second end of said expansion spring being secured to said second end cap by means of said threads;

whereby said suspension system attenuating both relative movement between said load and said vehicle and resultant forces transmitted by said relative movement from said load to said vehicle.

8. The suspension system claimed in claim 7 including a piston rod connecting means for connecting the distal end of said piston rod to one end of the positioning means and the load, and a housing rod connecting means for connecting the distal end of the housing rod to the other end of the positioning means and the load.

9. The suspension system claimed in claim 8 wherein the piston rod connecting means comprises an end hook threaded onto the distal end of the piston rod, and wherein the housing rod and connecting means is an end hook threaded onto the distal end of the housing rod.

10. The suspension system in question claimed in claim 7 including a telescoping cover the coaxial spring and shock absorber, said cover comprising a first tubular member fastened to said first end cap and a second tubular member fastened to said second end cap, said second tubular member being sized to slide within said first tubular member, said first tubular member extending substantially the entire distance from said first end cap to said second end cap, and said second tubular member extending substantially the entire distance from said second end cap to said first end cap.

11. In a suspension system for a plow blade mounted to a vehicle, the blade being raised and lowered by a blade support means, the blade being stabilized by a vehicular mount extending from the blade to the chassis of the vehicle and being pivotally mounted to both the blade and the chassis, an improvement comprising:

(a) a shock absorber being located between the blade support means and the blade, and a tension spring being mounted parallel with the shock absorber, one end of said spring being fastened to the end of said shock absorber, which is adjacent to the blade support means, the other end of said spring being fastened to the end of said shock absorber adjacent to the blade, whereby the spring and shock absorber cooperate to support the blade and attenuate impact-induced movements and forces.

12. The improvement claimed in claim 11 wherein the spring is a coil spring, and the shock absorber is positioned withing the inside diameter of said coil spring, whereby the shock absorber and the coil spring are coaxial.

* * * * *